US011338594B2

(12) United States Patent
Kaneko et al.

(10) Patent No.: US 11,338,594 B2
(45) Date of Patent: May 24, 2022

(54) LIQUID DISCHARGING APPARATUS

(71) Applicant: SEIKO EPSON CORPORATION, Tokyo (JP)

(72) Inventors: Kenichiro Kaneko, Okaya (JP); Seijun Horie, Matsumoto (JP); Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/065,908

(22) Filed: Oct. 8, 2020

(65) Prior Publication Data

US 2021/0107296 A1 Apr. 15, 2021

(30) Foreign Application Priority Data

Oct. 10, 2019 (JP) ..... JP2019-186600

(51) Int. Cl.
*B41J 11/00* (2006.01)
*B41J 29/17* (2006.01)

(52) U.S. Cl.
CPC ..... *B41J 11/007* (2013.01); *B41J 29/17* (2013.01)

(58) Field of Classification Search
CPC ..... B41J 11/007; B41J 29/17
See application file for complete search history.

(56) References Cited

U.S. PATENT DOCUMENTS 6,068,374 A * 5/2000 Kurata ..... B41J 3/4078 347/100
6,074,054 A * 6/2000 Katsuyama ..... B41J 3/4078 226/145
2004/0141041 A1* 7/2004 Tsutsumi ..... B41J 2/2056 347/102
2008/0094459 A1* 4/2008 Sakagami ..... B41J 11/0005 347/102
2008/0253797 A1* 10/2008 Sakagami ..... B41J 2/1714 399/92
2011/0261128 A1* 10/2011 Tokisawa ..... B41J 11/007 347/102
2018/0229510 A1* 8/2018 Endo ..... F01M 9/12
2019/0135565 A1* 5/2019 Kaburagi ..... B41J 11/007
2021/0107299 A1* 4/2021 Kaneko ..... B41J 15/048

FOREIGN PATENT DOCUMENTS

JP 2018-058283 A 4/2018

* cited by examiner

*Primary Examiner* — Justin Seo
(74) *Attorney, Agent, or Firm* — Workman Nydegger

(57) ABSTRACT

A liquid discharging apparatus includes a transporting belt having an endless shape stretched over a plurality of rollers and configured to rotate while supporting a medium by a support face being a face on an opposite side from a contact face with the roller, to transport the medium in a transport direction, a liquid discharging unit configured to discharge a liquid onto the medium supported by the support face, and a drying section configured to dry, from a side of the contact face, the liquid adhering to the contact face.

8 Claims, 2 Drawing Sheets

LIQUID DISCHARGING APPARATUS

The present application is based on, and claims priority from JP Application Serial Number 2019-186600, filed Oct. 10, 2019, the present disclosure of which is hereby incorporated by reference herein in its entirety.

BACKGROUND

1. Technical Field

The disclosure relates to a liquid discharging apparatus.

2. Related Art

In the related art, there has been used a liquid discharging apparatus configured to discharge liquid onto a medium while transporting the medium using a transporting belt having an endless shape that is stretched over a plurality of rollers. For example, JP 2018-58283 A discloses a printing apparatus configured to discharge an ink from a discharging head onto a printing medium while transporting the printing medium using an endless belt stretched between a belt rotating roller and a belt driving roller.

Unfortunately, in the liquid discharging apparatus in the related art configured to discharge liquid onto a medium while transporting the medium using a transporting belt having an endless shape that is stretched over a plurality of rollers as in the printing apparatus disclosed in JP 2018-58283 A, a mist of the discharged liquid may, for example, adhere to a side of the transporting belt, which makes contact with the roller, to moisten a contact face with the roller of the transporting belt Then, when the contact face with the roller of the transporting belt is moistened, the roller may slip with respect to the transporting belt, and there may be a risk of degrading the transport accuracy. Under such a circumstance, the present disclosure aims to suppress the degradation of the transport accuracy caused by the transporting belt.

SUMMARY

A liquid discharging apparatus of the present disclosure for resolving the above-described issue includes a transporting belt having an endless shape stretched over a plurality of rollers and configured to rotate while supporting a medium by a support face being a face on an opposite side from a contact face with the roller, to transport the medium in a transport direction, a liquid discharging unit configured to discharge a liquid onto the medium supported by the support face, and a drying section configured to dry, from a side of the contact face, the liquid adhering to the contact face.

DESCRIPTION OF EXEMPLARY EMBODIMENTS

Figure 1:
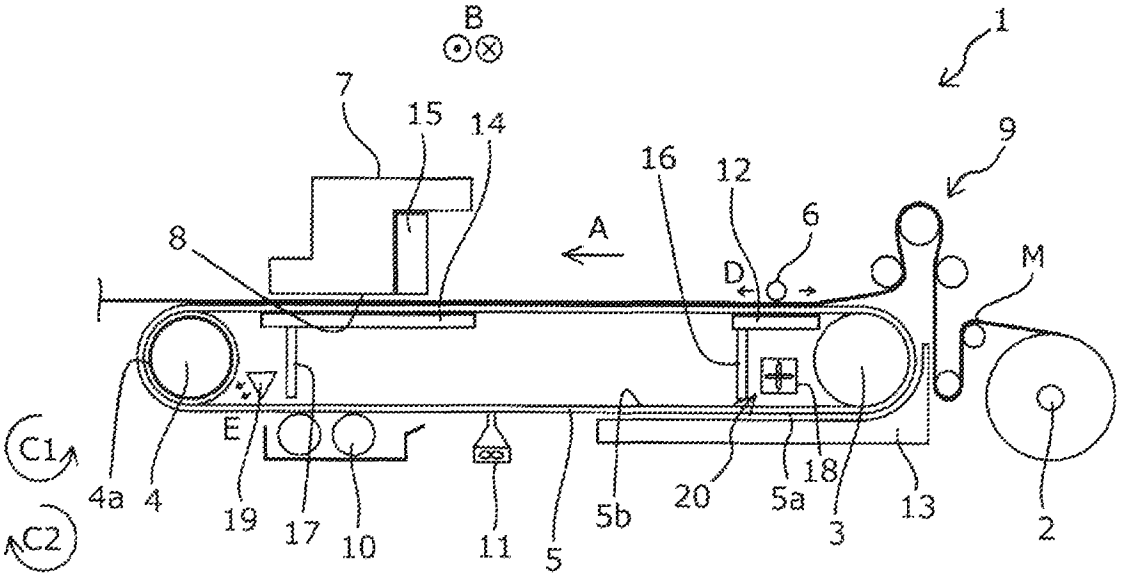
FIG. 1 is a schematic side view of a liquid discharging apparatus according to an example of the present disclosure.

First, the present disclosure will be schematically described.

A liquid discharging apparatus of a first aspect of the present disclosure for resolving the above-described issue includes a transporting belt having an endless shape stretched over a plurality of rollers and configured to rotate while supporting a medium by a support face being a face on an opposite side from a contact face with the roller, to transport the medium in a transport direction, a liquid discharging unit configured to discharge a liquid onto the medium supported by the support face, and a drying section configured to dry, from a side of the contact face, the liquid adhering to the contact face.

According to the above aspect, the drying section, which is provided to dry the liquid adhering to the contact face from the side of the contact face, can suppress the contact face from being moistened to cause slippage and the like of the transporting belt with respect to the roller, making it possible to suppress the degradation of the transport accuracy caused by the transporting belt.

A printing apparatus according to a second aspect of the disclosure includes, in the first aspect, a plurality of the retainers.

According to the above aspect, air is blown toward the contact face to cause the contact face to be dried while suppressing an excessive temperature rise of the transporting belt.

A liquid discharging apparatus of a third aspect of the present disclosure includes, in the above-described second aspect, a drive substrate for driving the transporting belt, in which the air-blowing section is configured to blow air heated by a heat toward the contact face, in which the heat is generated from the drive substrate.

According to the above aspect, the air heated by the heat generated from the drive substrate is blown toward the contact face, to thus cause the contact face to be efficiently dried.

A liquid discharging apparatus of a fourth aspect of the present disclosure includes, in the above-described second or third aspect, a cleaning section configured to clean the support face using a cleaning fluid, a support face heating section configured to heat the support face to dry the cleaning fluid, in which the air-blowing section is configured to blow air toward the contact face at a position corresponding to a heated region of the support face, in which the heated region is heated by the support face heating section.

According to the above aspect, air is blown toward the contact face at the position corresponding to the heated region of the support face, which is heated by the support face heating section, to thus cause the contact face to be efficiently dried.

A liquid discharging apparatus of a fifth aspect of the present disclosure includes, in any one of the above-described first to fourth aspects, a heating section, as the drying section, configured to heat the contact face.

According to the above aspect, the contact face is heated to cause the contact face to be dried while suppressing a generation of airflow inside the apparatus.

A liquid discharging apparatus of a sixth aspect of the present disclosure is the above-described fifth aspect, in which at least one of the plurality of rollers also serves as the heating section.

According to the above aspect, the at least one of the plurality of rollers, which also serves as the heating section. enables to form the heating section without preparing a new, another member, making it possible to simplify the apparatus configuration.

A liquid discharging apparatus of a seventh aspect of the present disclosure is the above-described fifth aspect, in which the heating section serves as a non-contact heater.

According to the above aspect, the heating section, which serves as the non-contact heater, can suppress a vibration and the like of the transporting belt in conjunction with the heating section making contact with the transporting belt.

A liquid discharging apparatus of an eighth aspect of the present disclosure is any one of the above-described fifth to seventh aspects, in which the transporting belt is applied with an adhesive on the support face, and the medium is transported in a state of being affixed by the adhesive to the support face at least in a region facing the liquid discharging unit, in which the heating section is disposed at a position such that a distance between the position and a closest roller among the plurality of the rollers, which is closest to where affixation of the medium to the support surface starts, is shorter than a distance between the position and the roller other than the closest roller among the plurality of rollers.

According to the above aspect, the heating section, which is disposed near the position at which the medium is firstly affixed to the support face, enhances an adhesiveness by a temperature rise of an adhesive in conjunction with heating the transporting belt, thus making it possible to effectively affix the medium to the support face.

A liquid discharging apparatus of a ninth aspect of the present disclosure is any one of the above-described first to eighth aspects, in which a partition for partitioning a drying region dried by the drying section is provided.

According to the above aspect, the partition, which is thus provided, can enhance a drying efficiency in the drying region.

A liquid discharging apparatus of a tenth aspect of the present disclosure includes, in the above-described ninth aspect, a platen for supporting the transporting belt from the side of the contact face, in which the partition is attached to the platen.

According to the above aspect, the partition, which is attached to the platen, can be effectively disposed without newly preparing a member to which the partition is attached.

Preferred embodiments of the present disclosure will be described below with reference to the accompanying drawings. First, an overview of a liquid discharging apparatus 1 according to an example of the present disclosure will be given with reference to FIG. 1.

As illustrated in FIG. 1, the liquid discharging apparatus 1 of the example includes a transporting belt 5 configured to rotate in a rotation direction C1 to transport a medium M in a transport direction A. The liquid discharging apparatus 1 also includes a feeding-out unit 2 configured, by setting the medium M in a rolled form, to rotate in the rotation direction C1 to feed out the medium M. The transporting belt 5 is configured to transport, in the transport direction A, the medium M fed-out from the feeding-out unit 2 via a group of rollers 9. The transporting belt 5 is an endless belt stretched over a driven roller 3 located upstream in the transport direction A and a driving roller 4 located downstream in the transport direction A.

Here, the transporting belt 5 is an adhesive belt applied with an adhesive on a support face 5*a* serving as an outside surface. As illustrated in FIG. 1, the medium M is transported while being supported by the transporting belt 5 in a state where the medium M is affixed to the support face 5*a* applied with the adhesive. A support region by which the transporting belt 5 supports the medium M coincides with an upside region stretched between the driven roller 3 and the driving roller 4. Further, the driving roller 4 is a roller configured to rotate under a driving force from a non-illustrated motor, and the driven roller 3 is a roller configured to rotate in response to the rotation of the transporting belt 5 in conjunction with causing the driving roller 4 to rotate.

The medium M fed-out from the group of rollers 9 to the transporting belt 5 is pressed by a press roller 6 to be affixed to the support face 5*a*. The press roller 6, which extends in a width direction B intersecting the transport direction A, is configured to be movable in a movement direction D that extends along the transport direction A. In addition, a configuration is employed in which a platen 12 is provided at a lower portion via the transporting belt 5 in a movement range in which the press roller 6 moves, and the medium M and the transporting belt 5 is caused to move, while clamping the medium M and the transporting belt 5 to be pressed by the press roller 6, in the movement direction D toward the platen 12, to make the medium M firmly affixed to the support face 5*a*. That is, the press roller 6 presses the medium M against the transporting belt 5 over the width direction B, to thus cause the medium M to be affixed to the transporting belt 5 in a state of suppressing the occurrence of wrinkles and the like.

The liquid discharging apparatus 1 also includes a carriage 7 configured to be reciprocally movable in the width direction B along a carriage shaft 15 extending in the width direction B, and a head 8 as a liquid discharging unit attached to the carriage 7. The head 8 is configured to discharge an ink as a liquid onto the medium M being transported in the transport direction A. There is provided a platen 14 in a region facing the head 8 with the transporting belt 5 interposed in between. The transporting belt 5, which is supported by the platen 14 in the region facing the head 8, is vibrated in the region facing the head 8 to suppress a deviation of the landing position at which the ink discharged from the head 8 is to land, to thus suppress a deterioration of image quality, which is caused by the deviation.

As such, the liquid discharging apparatus 1 of the example is configured to cause the head 8 to discharge an ink onto the medium M being transported to form an image while causing the carriage 7 to reciprocally move in the width direction B intersecting the transport direction A. The liquid discharging apparatus 1 of the example, which includes the carriage 7 thus configured, is configured to repeat transporting the medium M in the transport direction A by a predetermined transport amount and to cause the head 8 to discharge an ink while causing the carriage 7 to move in the width direction B in a state of stopping the medium M, to form a desired image on the medium M.

Note that the liquid discharging apparatus 1 of the example is so-called a serial printer configured to alternately repeat transporting the medium M by a predetermined amount and causing the carriage 7 to reciprocally move to perform printing, and the liquid discharging apparatus 1 may also be so-called a line printer configured to use a line head formed with nozzles in a line shape along the width direction B of the medium M, to successively perform printing while successively transporting the medium M.

Upon being discharged from the liquid discharging apparatus 1 of the example, the medium M formed with the image is fed to a drying apparatus for volatilizing constituents contained in the ink discharged onto the medium M, a winding apparatus for winding up the medium M formed with the image, and the like that are provided in stages that follow the liquid discharging apparatus 1 of the example.

Here, it is preferred that a textile printed material be used as the medium M. The term "textile printed material" refers to fabrics, garments, other clothing products, and the like on which textile printing is to be performed. The fabrics include natural fibers such as cotton, silk and wool, chemical fibers such as nylon, or composite fibers of the natural fibers and the chemical fibers such as woven clothes, knit fabrics, and non-woven clothes. Also, the garments and other clothing products include sewn products, such as T-shirt, handkerchief, scarf, towel, handbag, fabric bag, and furniture-related products, such as curtain, sheet, and bed cover, as well as fabrics and the like before and after cutting out that are present as parts of the products to be sewn.

Moreover, in addition to the textile printed material described above, exclusive paper dedicated to ink-jet printing, such as plain paper, high quality paper, or glossy paper, and the like may be used as the medium M. In addition, other materials that are usable as the medium M include, for example, plastic films without a surface treatment applied to serve as an ink absorption layer for ink-jet printing, as well as base materials such as paper applied with a coating of plastic materials and base materials bonded with a plastic film. Such plastic materials include, but are not particularly limited to, polyvinyl chloride, polyethylene terephthalate, polycarbonate, polystyrene, polyurethane, polyethylene, and polypropylene, for example.

When the textile printed material is used as the medium M, an ink easily seeps through the textile printed material, which is a phenomenon in which the ink discharged onto the medium M bleeds through to a rear surface of the medium M, and thus there are cases where the transporting belt 5 is stained by the ink. In view of the above, the liquid discharging apparatus 1 of the example includes a cleaning section 10 configured to clean ink deposits having seeped through and adhered to the support face 5*a* of the transporting belt 5. The cleaning section 10 includes a cleaning brush soaked with a cleaning fluid and making contact with the support face 5*a*. The cleaning section 10 also includes an air-blowing section 11 configured, by causing the cleaning brush to make contact with the support face 5*a*, to blow air to remove the cleaning fluid adhering to the support face 5*a*. Moreover, the liquid discharging apparatus 1 of the example includes a support face heating section 13 configured to heat and dry the cleaning fluid that has not completely been removed by the air-blowing section 11.

The liquid discharging apparatus 1 of the example is configured to cause the driving roller 4 to rotate in the rotation direction C1 to transport the medium M in the transport direction A. The liquid discharging apparatus 1 is also configured to cause the driving roller 4 to rotate in a rotation direction C2, which is an opposite direction from the rotation direction C1, to transport the medium M in an opposite direction from the transport direction A.

Note that, in a configuration in which a liquid is discharged from the liquid discharging unit toward the medium M as in the liquid discharging apparatus 1 of the example, a liquid not having landed on the medium M or a mist and the like generated in conjunction with discharging the liquid may be suspended to adhere to a contact face 5*b* with the driven roller 3 and the driving roller 4, in which the contact face 5*b* is on an opposite side from the support face 5*a* of the transporting belt 5. As such, when the liquid adheres to the contact face 5*b*, the transporting belt 5 may slip with respect to the driven roller 3 and the driving roller 4, resulting in the degradation of the transport accuracy. In view of the above, the liquid discharging apparatus 1 of the example includes a drying section configured to dry a liquid adhering to the contact face 5*b*.

Figure 2:
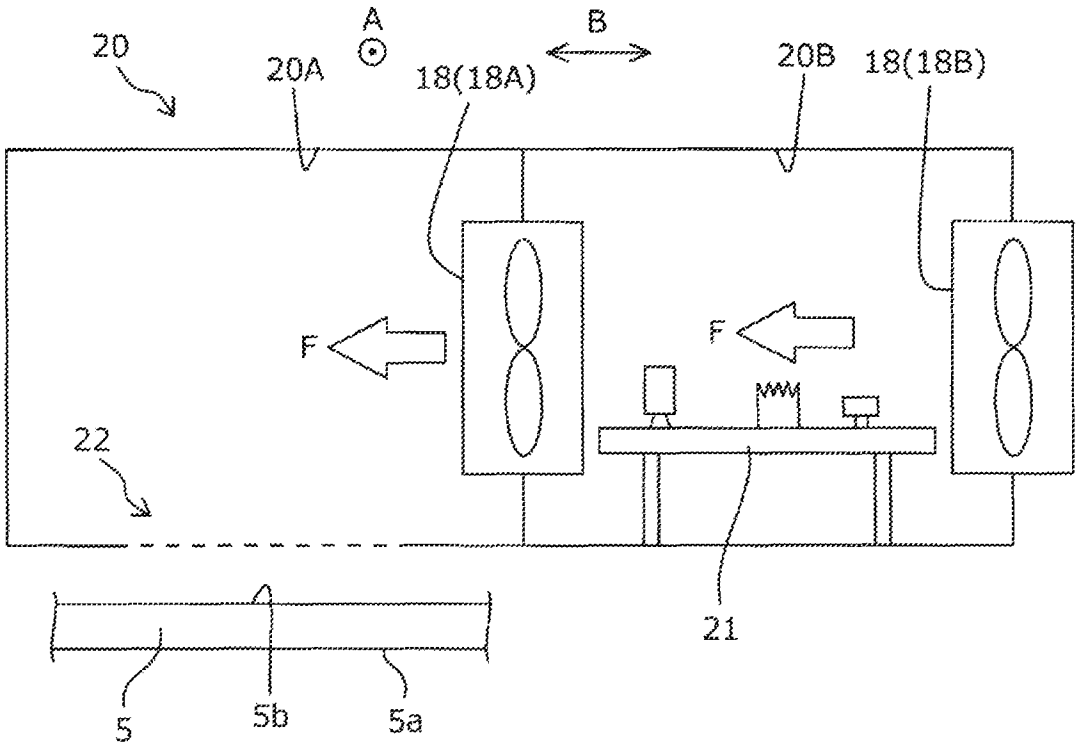
FIG. 2 is a schematic front view of an air-blowing section in a liquid discharging apparatus of FIG. 1.

Then, next, the drying section, which is a main portion of the liquid discharging apparatus 1 of the example will be described in detail with reference to FIGS. 1 and 2. As described below, the liquid discharging apparatus 1 of the example includes three types of the drying sections. However, the liquid discharging apparatus 1 may include, as the drying section, at least one of the three types of the drying sections described below, or a drying section having a configuration different from that of the three types of the drying sections described below, as long as the drying section can dry the liquid adhering to the contact face 5*b*.

First, the driving roller 4 as the drying section will be described. As illustrated in FIG. 1, the driving roller 4 of the example is a heat roller that includes an electrically heated wire 4*a*. Specifically, the driving roller 4 of the example is configured to cause a substrate 21 serving as a control unit illustrated in FIG. 2 to control the electrically heated wire 4*a* to heat the contact face 5*b* making contact with the driving roller 4, to thus cause the liquid adhering to the contact face 5*b* to be dried. Although no particular limitation is placed on constituent materials and the like of the transporting belt 5, the transporting belt 5 of the example employs an endless belt having an aramid core that has a small thermal expansion rate even when being heated.

Next, an infrared heater 19 as the drying section will be described. As illustrated in FIG. 1, the infrared heater 19 of the example, which is provided at a position closer to the driving roller 4 than the driven roller 3, is configured, by being controlled by the substrate 21, to irradiate infrared rays in an irradiation direction E toward the contact face 5*b* to heat the contact face 5*b*, to thus cause the liquid adhering to the contact face 5*b* to be dried.

Next, an air-blowing section 20 as the drying section will be described. As illustrated in FIG. 1, the air-blowing section 20 of the example is provided at a position closer to the driven roller 3 than the driving roller 4. Further, as illustrated in FIG. 2, the air-blowing section 20, which includes two pieces of fans 18 of fans 18A and 18B, is configured to blow air in an air-blowing direction F that extends along the width direction B. Note that the air-blowing section 20 of the example includes the two pieces of fans of the fans 18A and 18B as the fans 18, however, the air-blowing section 20 may be one of the fan 18A or the fan 18B, and may further include another fan in addition to the fans 18A and 18B.

Here, the air-blowing section 20 includes an air-blown region 20A located in an inner side region of the transporting belt 5, and a housing region 20B for housing the substrate 21 at a position deviated in the width direction B from the inner side region of the transporting belt 5. Then, the fan 18A and the fan 18B are both configured to blow air in the air-blowing direction F illustrated in FIG. 2. An airflow blown to the air-blown region 20A is discharged through an airflow discharge port 22 toward the contact face 5*b* of the transporting belt 5.

The air-blowing section 20, which has such a configuration, causes the fan 18A and the fan 18B to blow air to transmit the heat generated from the substrate 21, from the housing region 20B to the air-blown region 20A, and further, from the air-blown region 20A to the contact face 5*b* of the transporting belt 5. That is, the air-blowing section 20 is configured to blow air heated by the heat generated from the substrate 21 to the contact face 5*b*, to cause the liquid adhering to the contact face 5*b* to be dried. In addition, an effect of air-cooling the substrate 21 is also obtained. Here, it is preferred to provide a temperature sensor for detecting a temperature of the air-blown region 20A and a humidity sensor for detecting a humidity of the same, and to control the air-blowing section and the heating section such that the temperature and humidity of the air-blown region 20A falls within a predetermined range. Note that the temperature sensor and the humidity sensor can be installed on the platen 12, a flat plate 16, or the like.

As described above, the liquid discharging apparatus 1 of the example includes the transporting belt 5 having an endless shape stretched between the driven roller 3 and the driving roller 4 as a plurality of rollers, and configured to rotate while supporting the medium M by the support face 5*a* being a face on an opposite side from the contact face 5*b*, to transport the medium M in the transport direction A, the head 8 configured to discharge an ink onto the medium M supported by the support face 5*a*, and the drying section configured to dry the ink adhering to the contact face 5*b* from a side of the contact face 5*b*.

As such, the drying section, which is provided to dry the liquid adhering to the contact face 5*b* from the side of the contact face 5*b*, can suppress the contact face from being moistened to cause slippage and the like of the transporting belt 5 with respect to the driven roller 3 and the driving roller 4, making it possible to suppress the degradation of the transport accuracy caused by the transporting belt 5. Note that in the liquid discharging apparatus 1 of the example, a drying condition of the drying section is set such that a liquid such as ink adhering to the contact face 5*b* is substantially completely dried. This makes it possible to particularly effectively suppress the contact face 5*b* from being moistened to cause a slippage. However, it suffices that the liquid adhering to the contact face 5*b* be dried to an extent that substantially does not cause the degradation of the transport accuracy caused by the transporting belt 5, that is, to an extent that substantially does not cause a time-dependent change in the transport accuracy, without being limited to such a configuration. Note that, in order to further suppress the degradation of the transport accuracy caused by the transporting belt 5, an encoder or the like may be provided to manage the transport accuracy.

Here, as described above, the liquid discharging apparatus 1 of the example includes the air-blowing section 20 configured, as the drying section, to blow air toward the contact face 5*b*. When excessively using, as the drying section, the heating section configured to heat the transporting belt, there may be a risk of an excessive temperature rise of the transporting belt, however, the fan 18 or the like is used to blow air toward the contact face 5*b*, to thus cause the contact face 5*b* to be dried while suppressing the excessive temperature rise of the transporting belt 5.

Further, as described above, the liquid discharging apparatus 1 of the example includes the substrate 21 serving as the drive substrate for driving the transporting belt 5, and the air-blowing section 20 is configured to blow air heated by a heat, which is generated from the substrate 21, toward the contact face 5*b*. This allows the liquid discharging apparatus 1 of the example to efficiently dry the contact face 5*b*.

In addition, as described above, the liquid discharging apparatus 1 of the example includes the cleaning section 10 configured to clean the support face 5*a* using a cleaning fluid, and the support face heating section 13 configured to heat the support face 5*a* to cause the cleaning fluid to dried, in which the air-blowing section 20 is disposed to blow air toward the contact face 5*b* at a position corresponding to a heated region of the support face 5*a*, which is heated by the support face heating section 13, that is, at a position on an opposite side from the heated region, as illustrated in FIG. 1. As such, air is blown toward the contact face 5*b* at the position corresponding to the heated region of the support face 5*a*, which is heated by the support face heating section 13, to thus enable air to be blown toward the contact face 5*b* heated in conjunction with heating the support face 5*a*, causing the contact face to be efficiently dried.

As described above, the liquid discharging apparatus 1 of the example also includes the driving roller 4 being the heat roller and the infrared heater 19 that serve as the heating section configured to heat the contact face 5*b* as the drying section. When causing an excessive airflow to be generated inside the apparatus, there may be a risk of causing displacement to occur in a discharge direction in which the ink is discharged, however, the heating section thus configured is used to heat the contact face 5*b*, to thus cause the contact face 5*b* to be dried while suppressing an excessive generation of the airflow inside the apparatus. Note that in the liquid discharging apparatus 1 of the example, the substrate 21 controls a temperature of the driving roller 4 and the infrared heater 19 to make a temperature of the transporting belt 5 lower than 80 degrees Celsius.

Here, as in the liquid discharging apparatus 1 of the example, at least one of the plurality of rollers across which the transporting belt 5 is stretched, which also serves as the heating section, enables to form the heating section without preparing a new, another member, making it possible to simplify the apparatus configuration. Note that in the example, the driving roller 4 serves as the heat roller as the heating section, however, the driven roller 3 may serve as the heat roller as the heating section, and the driving roller 4 and the driven roller 3 may both serve as the heat roller as the heating section.

Further, the infrared heater 19 as the heating section serves as a non-contact heater. As such, the heating section, which serves as the non-contact heater, can suppress a vibration and the like of the transporting belt 5 in conjunction with the heating section making contact with the transporting belt 5.

Note that the transporting belt 5 of the liquid discharging apparatus 1 of the example is applied with an adhesive on the support face 5*a*, and the medium M is transported in a state of being affixed by an adhesive to the support face 5*a* at least in the region facing the head 8. In the liquid discharging apparatus 1 having such a configuration, it is preferred that the heating section be disposed at a position closer to the driven roller 3 upstream in the transport direction A of the driving roller 4 that is located downstream in the transport direction A. In other words, it is preferred that the heating section is disposed at a position such that a distance between the position and a closest roller among the plurality of the rollers stretched over the transporting belt 5, which is closest to where affixation of the medium M to the support surface 5*a* starts, is shorter than a distance between the position and the roller other than the closest roller among the plurality of rollers. This is because the heating section, which is disposed near the position at which the medium M is firstly affixed to the support face 5*a*, enhances an adhesiveness by a temperature rise of an adhesive in conjunction with heating the transporting belt 5, thus making it possible to effectively affix the medium M to the support face 5*a*.

However, it goes without saying that the heating section may be disposed at a position closer to the driving roller 4 downstream in the transport direction A of the driven roller 3 that is located upstream in the transport direction A, as in the liquid discharging apparatus 1 of the example. Note that the transporting belt 5 may be stretched over three or more rollers, and in case of such a configuration, it is preferred that the heating section be disposed at a position near the roller 3 that is located closest to the position at which the medium M is firstly affixed to the support face 5*a*.

Here, as illustrated in FIG. 1, the liquid discharging apparatus 1 of the example is provided with the flat plate 16 and a flat plate 17. The flat plates 16 and 17, which extend in the width direction B, serve as partitions for partitioning a drying region dried by the drying section. The partitions, which are provided as such, can enhance a drying efficiency in the drying region.

Note that, as described above, the liquid discharging apparatus 1 of the example includes the platens 12 and 14 for supporting the transporting belt 5 from the side of the contact face 5*b*, in which the flat plate 16 is attached to the platen 12, and the flat plate 17 is attached to the platen 14. As such, the partitions, which are attached to the platens, can be effectively disposed without newly preparing members to which the partitions are attached.

Note that the present disclosure is not limited to the aforementioned example, and many variations are possible within the scope of the present disclosure as described in the appended claims. It goes without saying that such variations also fall within the scope of the present disclosure.

What is claimed is:

1. A liquid discharging apparatus, comprising:

a transporting belt having an endless shape stretched over a plurality of rollers and configured to rotate while supporting a medium by a support face being a face on an opposite side from a contact face with the rollers, to transport the medium in a transport direction;

a liquid discharging unit configured to discharge a liquid onto the medium supported by the support face; and a drying section configured to dry, from a side of the contact face, the liquid adhering to the contact face, wherein as the drying section, an air-blowing section is configured to blow air toward the contact face.

2. The liquid discharging apparatus according to claim 1, comprising a drive substrate for driving the transporting belt, wherein the air-blowing section is configured to blow air, heated by heat generated from the drive substrate, toward the contact face.

3. The liquid discharging apparatus according to claim 1, comprising a cleaning section configured to clean the support face using a cleaning fluid, a support face heating section configured to heat the support face to dry the cleaning fluid, wherein the air-blowing section is configured to blow air toward the contact face at a position corresponding to a heated region of the support face heated by the support face heating section.

4. A liquid discharging apparatus, comprising:

a transporting belt having an endless shape stretched over a plurality of rollers and configured to rotate while supporting a medium by a support face being a face on an opposite side from a contact face with the rollers, to transport the medium in a transport direction;

a liquid discharging unit configured to discharge a liquid onto the medium supported by the support face; and a drying section configured to dry, from a side of the contact face, the liquid adhering to the contact face, wherein as the drying section, a heating section is configured to heat the contact face, and wherein the heating section is a non-contact heater.

5. The liquid discharging apparatus according to claim 4, wherein at least one of the plurality of rollers also serves as the heating section.

6. The liquid discharging apparatus according to claim 4, wherein the transporting belt has an adhesive applied at the support face, and the medium is transported in a state of being affixed by the adhesive to the support face at least in a region facing the liquid discharging unit, wherein the heating section is disposed at a position such that a distance between the position and a closest roller among the plurality of the rollers, which is closest to where affixation of the medium to the support surface starts, is shorter than a distance between the position and the roller other than the closest roller among the plurality of rollers.

7. A liquid discharging apparatus, comprising:

a transporting belt having an endless shape stretched over a plurality of rollers and configured to rotate while supporting a medium by a support face being a face on an opposite side from a contact face with the rollers, to transport the medium in a transport direction;

a liquid discharging unit configured to discharge a liquid onto the medium supported by the support face; and a drying section configured to dry, from a side of the contact face, the liquid adhering to the contact face, wherein a partition for partitioning a drying region dried by the drying section is provided.

8. The liquid discharging apparatus according to claim 7, comprising a platen for supporting the transporting belt from the side of the contact face, wherein the partition is attached to the platen.

* * * * *